US008757992B2

(12) United States Patent
Chu

(10) Patent No.: US 8,757,992 B2
(45) Date of Patent: Jun. 24, 2014

(54) AIR COMPRESSION DEVICE

(75) Inventor: Yi-Lin Chu, New Taipei (TW)

(73) Assignee: Cycle Arrow Technology Co., Ltd., New Taipei (TW)

( * ) Notice: Subject to any disclaimer, the term of this patent is extended or adjusted under 35 U.S.C. 154(b) by 382 days.

(21) Appl. No.: 13/212,744

(22) Filed: Aug. 18, 2011

(65) Prior Publication Data

US 2012/0045354 A1 Feb. 23, 2012

(30) Foreign Application Priority Data

Aug. 18, 2010 (TW) ..... 99215891 U

(51) Int. Cl.
*F03C 2/00* (2006.01)
*F03C 4/00* (2006.01)
*F04C 2/00* (2006.01)

(52) U.S. Cl.
USPC ..... 418/21; 418/131; 418/206.1; 418/206.2; 418/206.7

(58) Field of Classification Search
USPC ..... 418/19, 21, 24, 28–29, 131–132, 418/206.1–206.2, 206.7
See application file for complete search history.

(56) References Cited

U.S. PATENT DOCUMENTS

| | | | | | |
|---|---|---|---|---|---|
| 815,522 | A * | 3/1906 | Fraser | 418/21 |
| 2,684,636 | A * | 7/1954 | Heldenbrand | 418/21 |
| 3,588,295 | A * | 6/1971 | Burk | 418/21 |
| 5,184,947 | A * | 2/1993 | Coombe | 418/21 |
| 5,306,127 | A * | 4/1994 | Kinney | 418/21 |
| 5,724,812 | A * | 3/1998 | Baker | 418/21 |
| 6,283,735 | B1 * | 9/2001 | Schreiber et al. | 418/21 |
| 7,179,070 | B2 * | 2/2007 | O'Brien, II | 418/206.1 |

* cited by examiner

*Primary Examiner* — Theresa Trieu
(74) *Attorney, Agent, or Firm* — Muncy, Geissler, Olds & Lowe, P.C.

(57) ABSTRACT

An air compression device is applied in an air compressor, and mainly includes a first rotor, a second rotor, a stop disk, a transmission element and a drive element. When external air enters an air chamber in the air compression device, the air is rotated and compressed by the first rotor and the second rotor, and then is exhausted, the transmission element generates axial displacement vertically according to actual requirements on air admission or exhaust, and drives the drive element and the first rotor to displace, so as to change a capacity of the air chamber, and adjust the air output.

18 Claims, 13 Drawing Sheets

AIR COMPRESSION DEVICE

BACKGROUND OF THE INVENTION

1. Field of the Invention

The present invention relates to an air compression device assembled in an air compressor, and more particularly to an air compression device capable of adjusting an air chamber capacity to change air input and air output.

2. Related Art

An air compression device is generally assembled in an air compressor, so as to compress and then exhaust the air inhaled by the air compressor. FIG. 1 illustrates a conventional air compression device. Referring to FIG. 1, an air chamber 101 is formed in the air compression device 10, a first rotor 1011 and a second rotor 1012 are assembled in the air chamber 101, and the air chamber 101 is in communication with an air inlet 102 and an air outlet (not shown). When the air enters the air chamber 101 through the air inlet 102, the first rotor 1011 and the second rotor 1012 are driven to rotate at the same time. When the two rotors (1011, 1012) rotate, the air is compressed to generate compression air, and then the compression air is exhausted through the air outlet. Through the above operation, a process of air admission, compression, and exhaust is successively completed. In the conventional air compression device 10, the air chamber 101 is fixed in capacity, and generates fixed air output and fixed power accordingly. When a user needs to increase the air output to generate higher power due to a power demand, the air output generated by the air compression device 10 is increased by adjusting an air compression rate of the first rotor 1011 and the second rotor 1012. Through such operation, the air output may be increased to improve the power output, but the more the air output improves, the more motor power the two rotors (1011, 1012) consume. In addition, when the required power output is smaller than the minimum power provided by the air compression device 10, energy waste is caused. Moreover, when the two rotors (1011, 1012) operate, the rate has a limit value, and when the required power output is greater than the rated power provided by the air compression device 10, insufficient air output is caused, and the power cannot be improved. If the above air compression device 10 is applied to an air intake system of a vehicle engine, the required air output of a car apparently and greatly differs from that of a moped. However, in order to achieve various demands on the air output, many groups of the air compression devices 10 need to be used in coordination, which causes rather high limitation for the application of the compression air, and does not conform to the consideration on the manufacturing cost.

SUMMARY OF THE INVENTION

In view of the above problems, the present invention is directed to provide an air compression device, which can adjust a capacity of a chamber according to power demands, so as to change the air input and air output.

In order to achieve the objective, the air compression device mainly includes a first rotor and a second rotor. Through the assembly of a transmission element and a drive element, when external air enters an air chamber, the air is relatively compressed by the first rotor and the second rotor to generate compression air. When an air output demand is changed, the transmission element may generate coaxial relative displacement to drive the first rotor and the second rotor to axially displace vertically, so that the capacity of the air chamber is changed, thereby changing the air output of the air chamber, and further adjusting power provided by the air compression device.

DETAILED DESCRIPTION OF THE INVENTION

Figure 1:
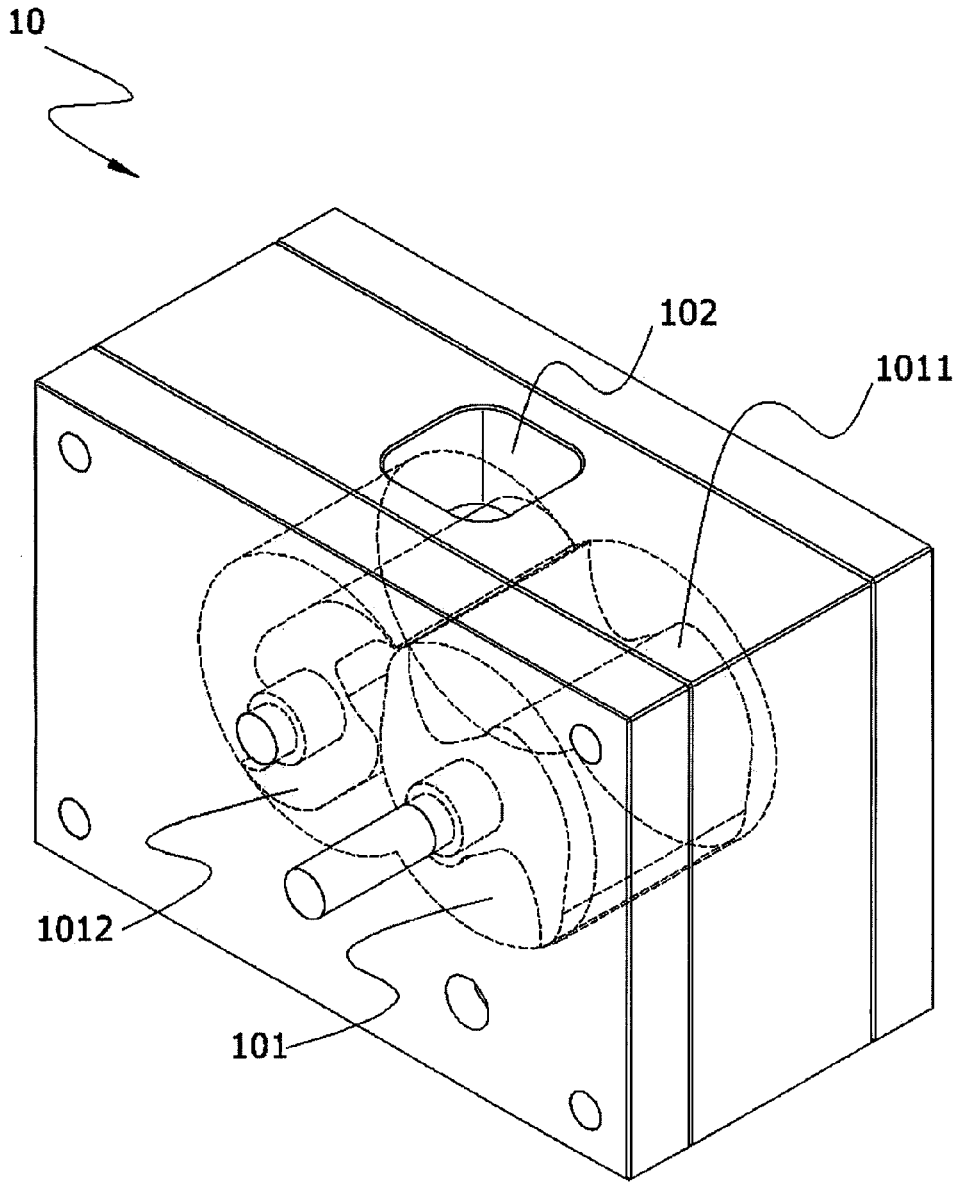
Prior Art FIG. 1
FIG. 1 illustrates a conventional air compression device.
Figure 2:
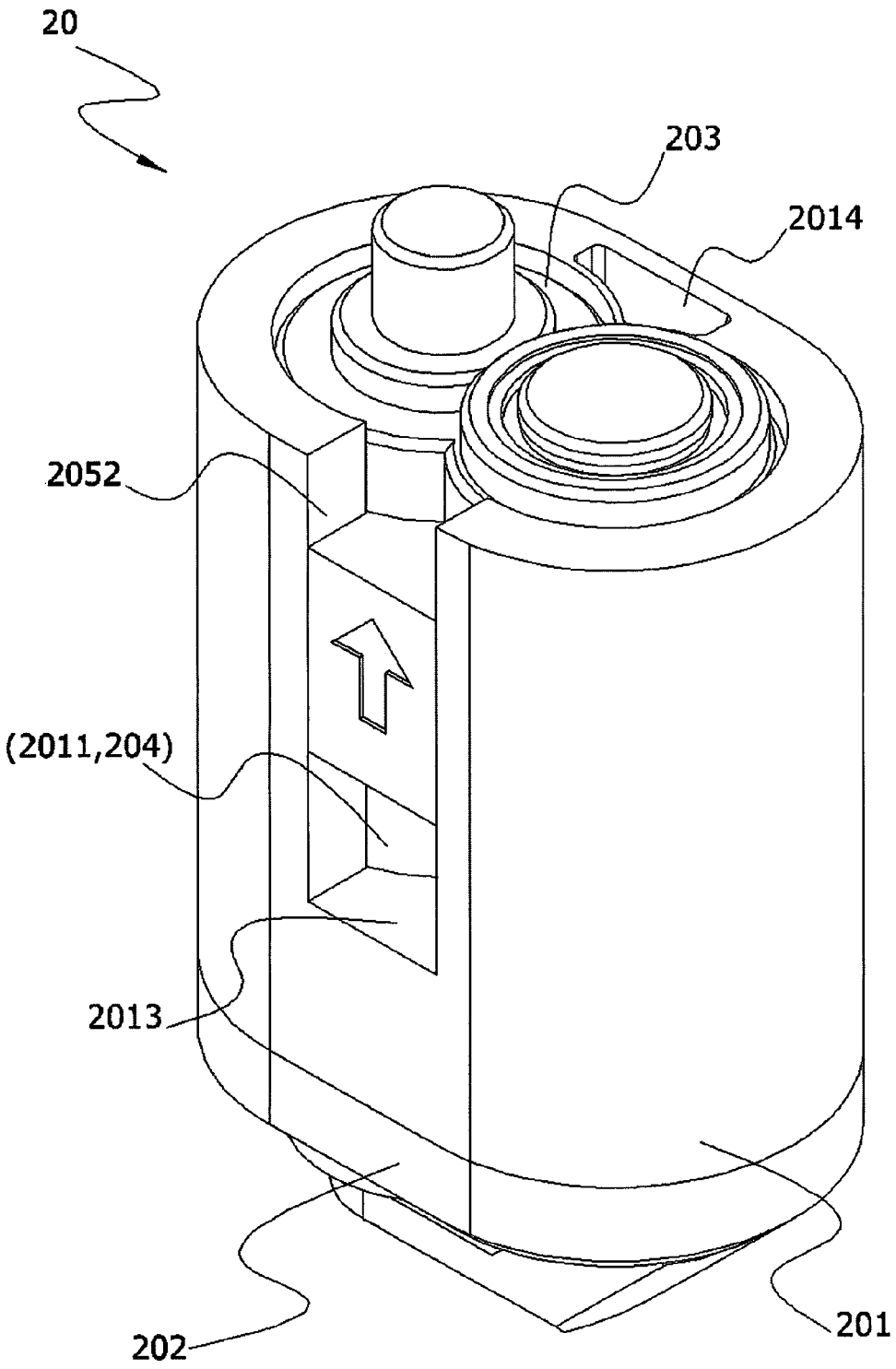
FIG. 2 is a three-dimensional appearance view of the present invention.

FIG. 2 is a three-dimensional appearance view of the present invention. Referring to FIG. 2, in an air compression device 20, a lower edge of a housing 201 is assembled with a supporting base 202, an upper edge of the housing 201 is assembled with a transmission element 203, and the housing 201 is half-closed. When the supporting base 202 and the transmission element 203 are completely assembled, an air chamber 2011 is formed, and a first rotor 204 and a second rotor 205 (not shown) are assembled therein. The upper edge of the housing 201 extends downwards to form a groove 2012 (not shown). When the transmission element 203 is assembled on the upper edge of the housing 201, an air inlet 2013 is formed in the groove 2012, an exhaust channel 2014 is formed in the housing 201, and the exhaust channel 2014 is in communication with the air chamber 2011. In this way, a user may adjust a position of the transmission element 203 to change a capacity of the air chamber 2011 and the size of the air inlet 2013. Therefore, the air input and air output generated by the air compression device 20 may be changed according to different use conditions, thereby changing the provided power.

Figure 3:
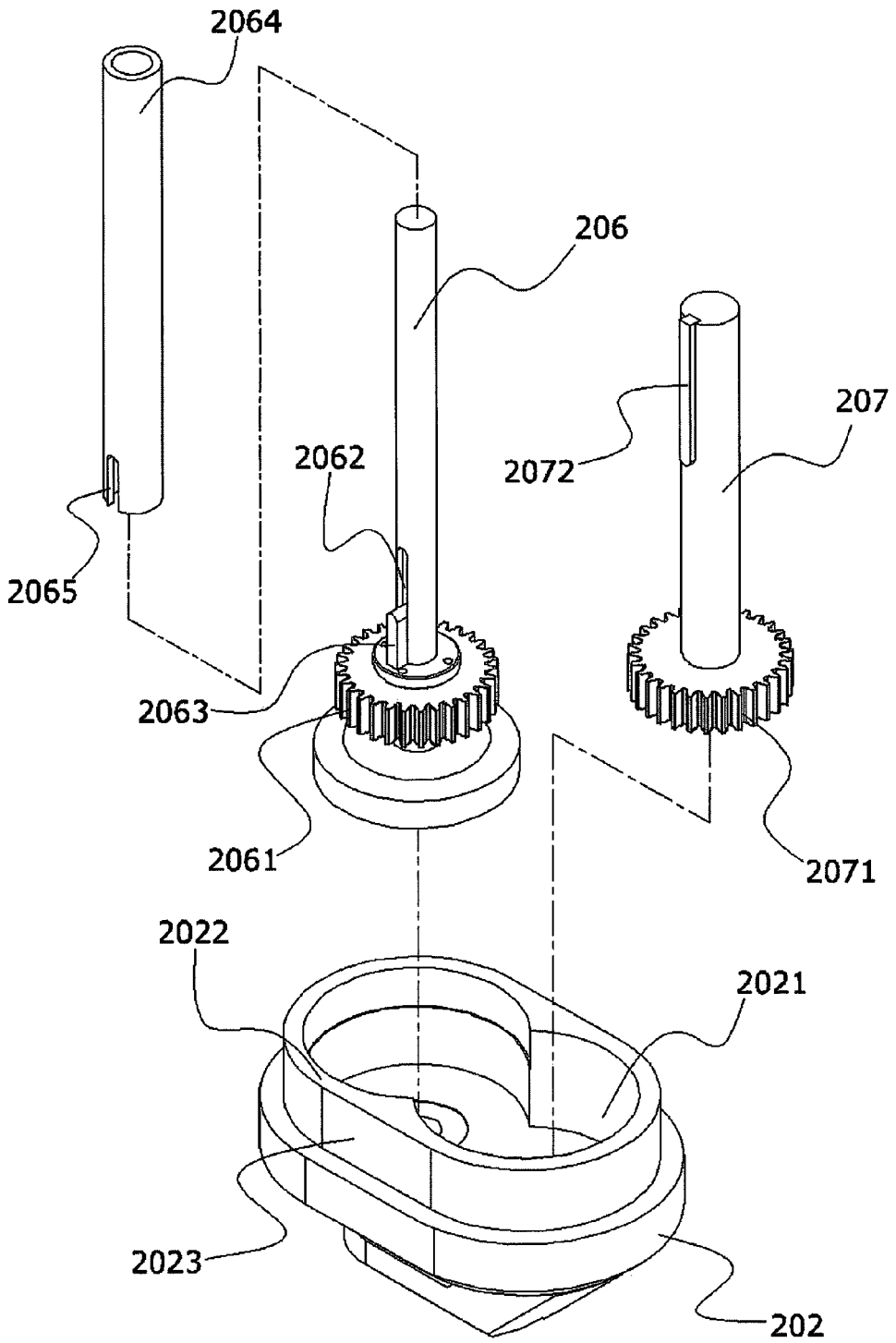
FIG. 3 is a schematic assembly view (1) of components of the present invention.

FIG. 3 is a schematic assembly view (1) of components of the present invention. Referring to FIG. 3, an accommodation space 2021 is formed in the supporting base 202, a periphery of the accommodation space 2021 has a bulkhead 2022, and a height of the bulkhead 2022 is higher than that of the supporting base 202, and then a sleeve portion 2023 is formed on an edge of the supporting base 202, so that the housing 201 (as shown in FIG. 2) is sleeved on the sleeve portion 2023. In addition, a rotation shaft 206 and a relative rotation shaft 207 are assembled in the accommodation space 2021 of the supporting base 202, and the rotation shaft 206 and the relative rotation shaft 207 are respectively formed into a columnar shape. An actuation portion 2061 is formed on a bottom edge of the rotation shaft 206, and a slide portion 2062 is formed on a position close to the actuation portion 2061 and is groove-shaped. A slide block 2063 is assembled inside the slide portion 2062, and may coaxially displace in the slide portion 2062 back and forth. In addition, a rotation shaft casing 2064 is sleeved on the rotation shaft 206, a stop portion 2065 is formed on a bottom edge of the rotation shaft casing 2064, and the size of the stop portion 2065 is corresponding to the slide block 2063. When the rotation shaft casing 2064 is sleeved on the rotation shaft 206, the slide block 2063 and the stop portion 2065 are closely fitted, so that the rotation shaft casing 2064 is displaced by driving the slide block 2063 to axially move back and forth. Moreover, a relative actuation portion 2071 is assembled on a position close to a bottom edge of the rotation shaft 207, and an upper edge of the rotation shaft 207 is assembled with a protruding rib 2072. In this way, when the rotation shaft 206 and the relative rotation shaft 207 are completely assembled, the actuation portion 2061 operates and drives the relative actuation portion 2071 to operate. Furthermore, the two actuation portions (2061, 2071) may be gears, and are in a mutually engaged aspect after assembling. In addition, the protruding rib 2072 may be formed in the following manner: an assembling portion is formed on the relative rotation shaft 207, and then a protruding pillar is assembled therein, so as to form the protruding rib 2072.

Figure 4:
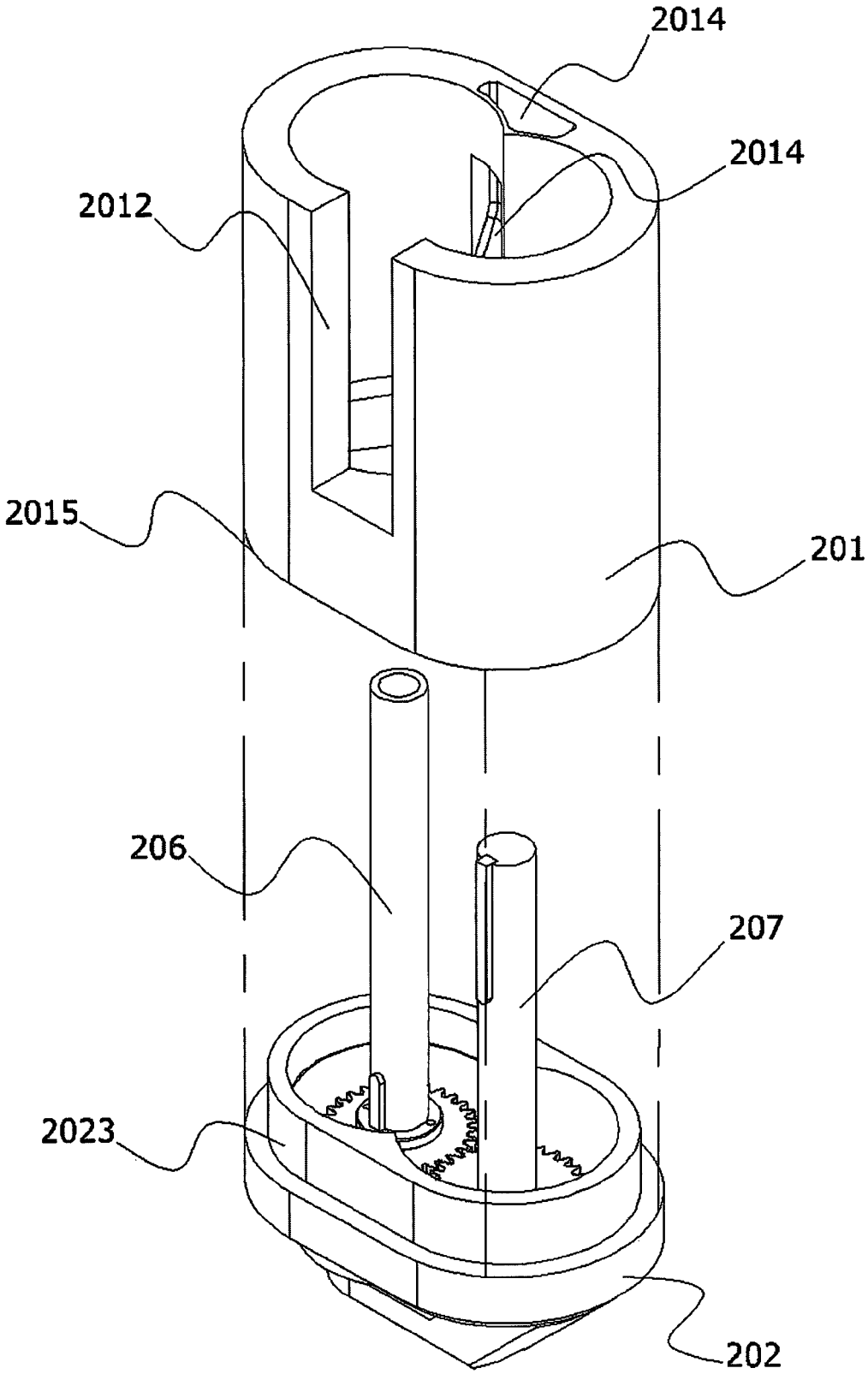
FIG. 4 is a schematic assembly view (2) of components of the present invention.
Figure 5:
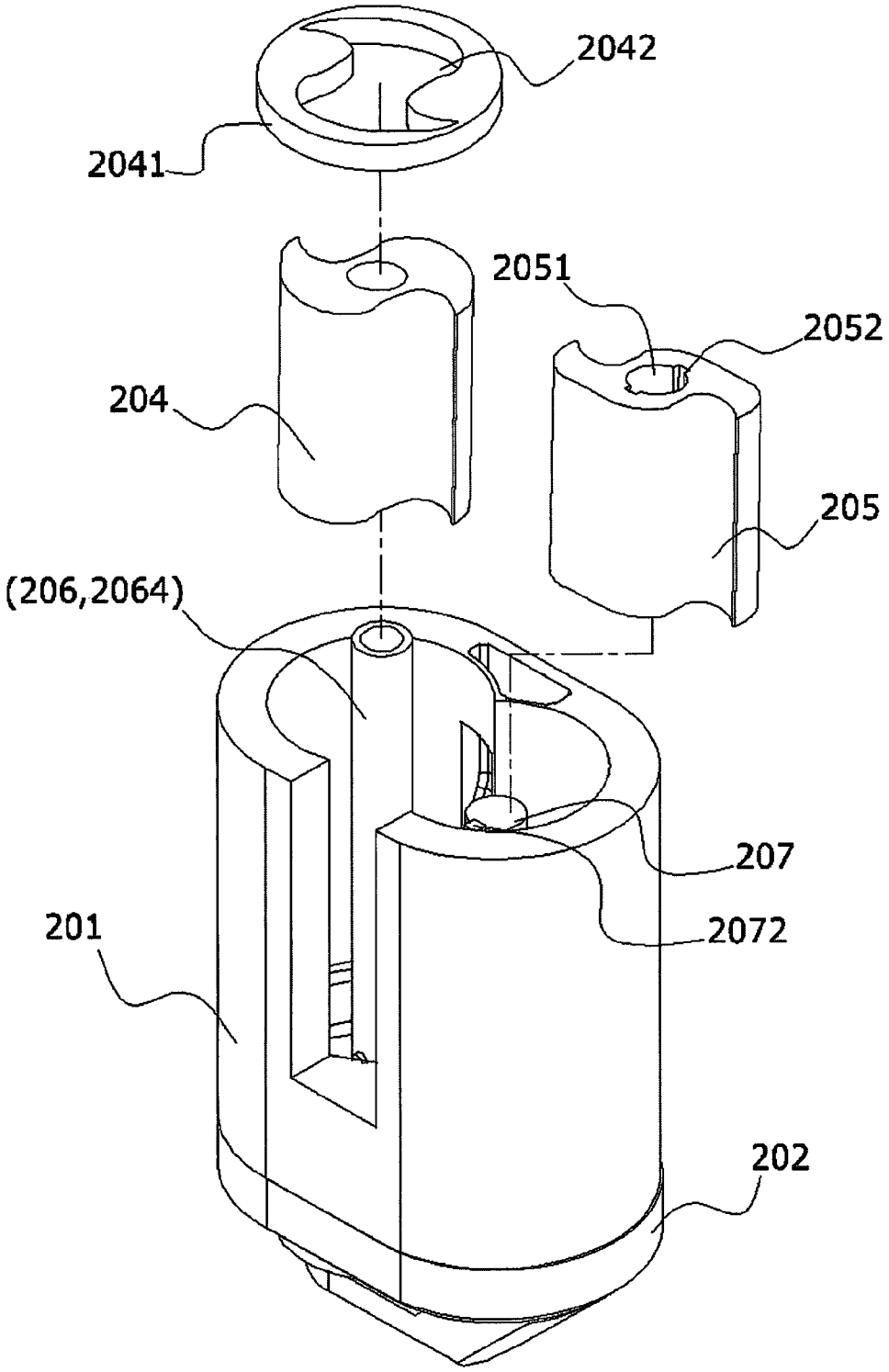
FIG. 5 is a schematic assembly view (3) of components of the present invention.
Figure 6:
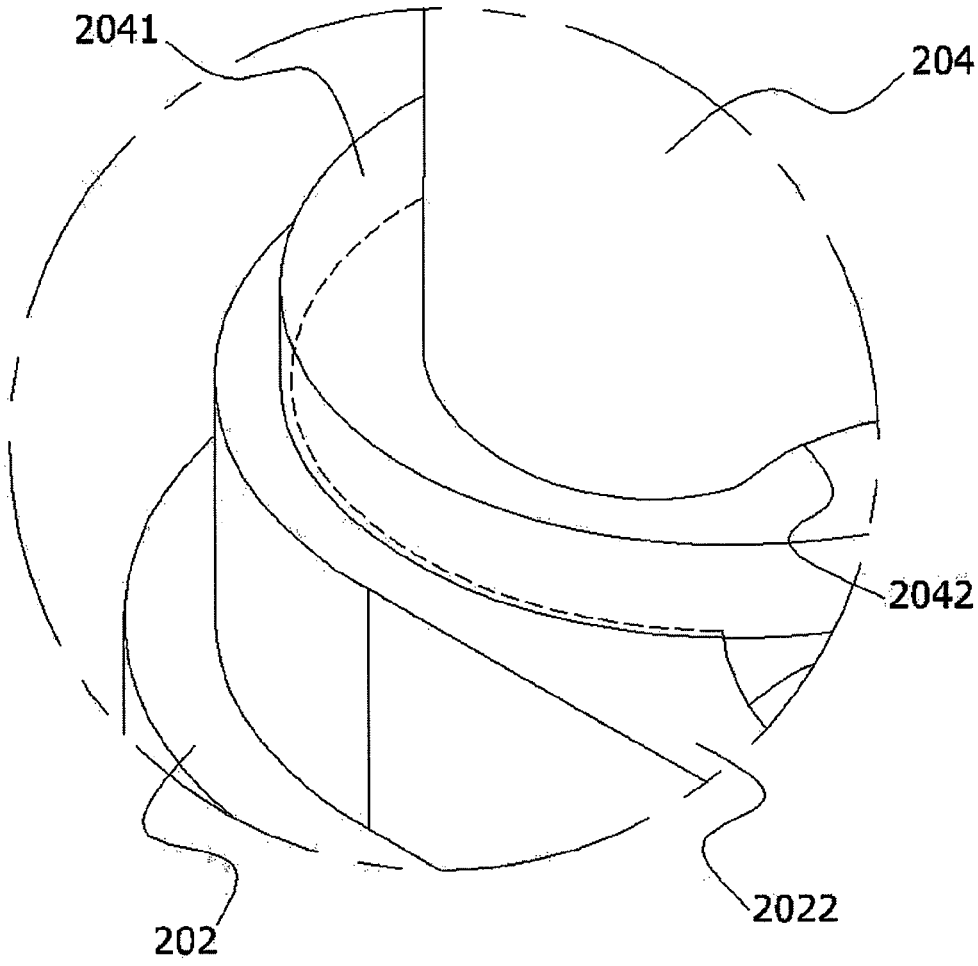
FIG. 6 is a schematic assembly view (4) of components of the present invention.

FIG. 4 is a schematic assembly view (2) of components of the present invention. Referring to FIG. 4, after the above components are assembled, a housing 201 is sleeved on a sleeve portion 2023 of the supporting base 202, in which the housing 201 is half-closed. A relative sleeve portion 2015 is formed on a lower edge of the housing 201, an upper edge of the housing 201 extends downwards to form a groove 2012, and an exhaust channel 2014 is formed in the exhaust housing 201, and passes through the upper edge and an internal edge of the housing 201. In addition, more than one through hole (not shown) is formed in the bottom edge of the housing 201, and the size of the through holes may be changed according to the size of the component. During assembling, the relative sleeve portion 2015 and the sleeve portion 2023 are completely assembled, and the two rotation shafts (206, 207) penetrate the through holes. In this way, the components formed through the above assembly are covered by the housing 201. FIG. 5 is a schematic assembly view (3) of components of the present invention. Referring to FIG. 5, after the housing 201 finishes the assembling, a rotor group is assembled. The first rotor 204 and the second rotor 205 are in a columnar shape respectively, and the two rotors (204, 205) are respectively sleeved on the two rotation shafts (206, 207). In addition, the second rotor 205 has an assembling hole 2051, and an assembling groove 2052 is formed on an inner edge of the assembling hole 2051, so that during the assembling of the second rotor 205, the second rotor 205 may be assembled on the relative rotation shaft 207 by penetrating the protruding rib 2072 on the relative rotation shaft 207 through the assembling groove 2052. Further, when the two rotors (204, 205) are completely assembled, the two rotors are closely fitted with the rotation shaft 206 and the relative rotation shaft 207 respectively, and are misaligned with each other. In addition, after the two rotors (204, 205) are completely assembled, relative rotation may be generated through the drive of the actuation portion 2061 and the relative actuation portion 2071. Furthermore, after the first rotor is completely assembled, a stop disk 2041 is sleeved on the first rotor 204, and a through hole 2042 is formed in the stop disk 2041, in which the shape and the size of the through hole 2042 correspond to the first rotor 204. FIG. 6 is a schematic assembly view (4) of components of the present invention. Referring to FIG. 6, the stop disk 2041 is sleeved at the lower edge portion of the first rotor 204, and the lower edge portion of the first rotor 204 is received in the accommodation space 2021, a part of the edge of the stop disk 2041 presses against the upper edge of the bulkhead 2022, and the first rotor 204 is closely attached to the stop disk 2041. In this way, the first rotor 204 operates due to the rotation of the rotation shaft, and the stop disk 2041 is driven by the first rotor 204 and slides on the bulkhead 2022. When the first rotor 204 is driven by the rotation shaft casing 2064 (see FIG. 5) to displace, an overlapping position of the first rotor 204 and the stop disk 2041 is changed, so that the first rotor 204 axially displaces vertically in the stop disk 2041.

Figure 7:
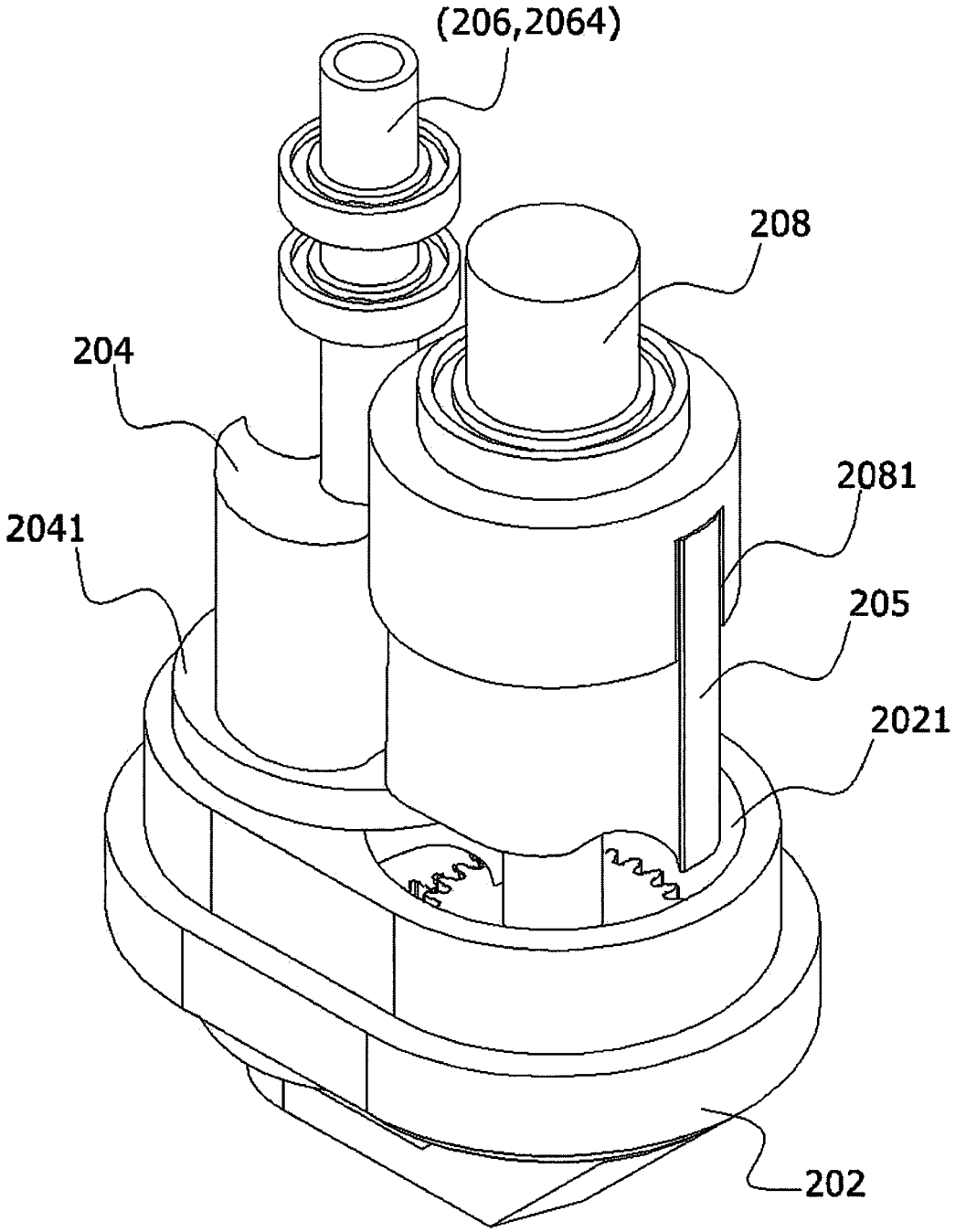
FIG. 7 is a schematic assembly view (5) of components of the present invention.
Figure 8:
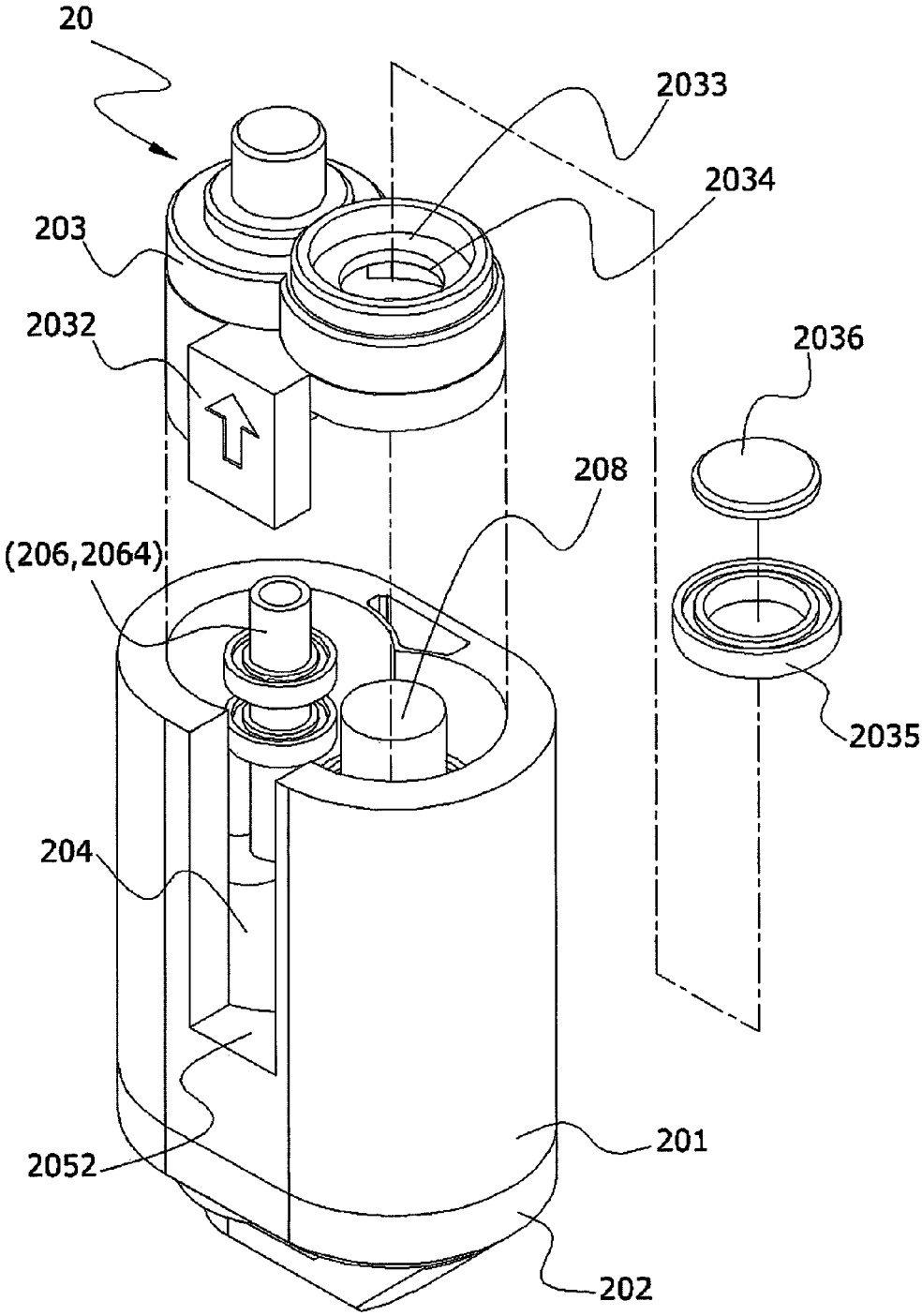
FIG. 8 is a schematic assembly view (6) of components of the present invention.
Figure 9:
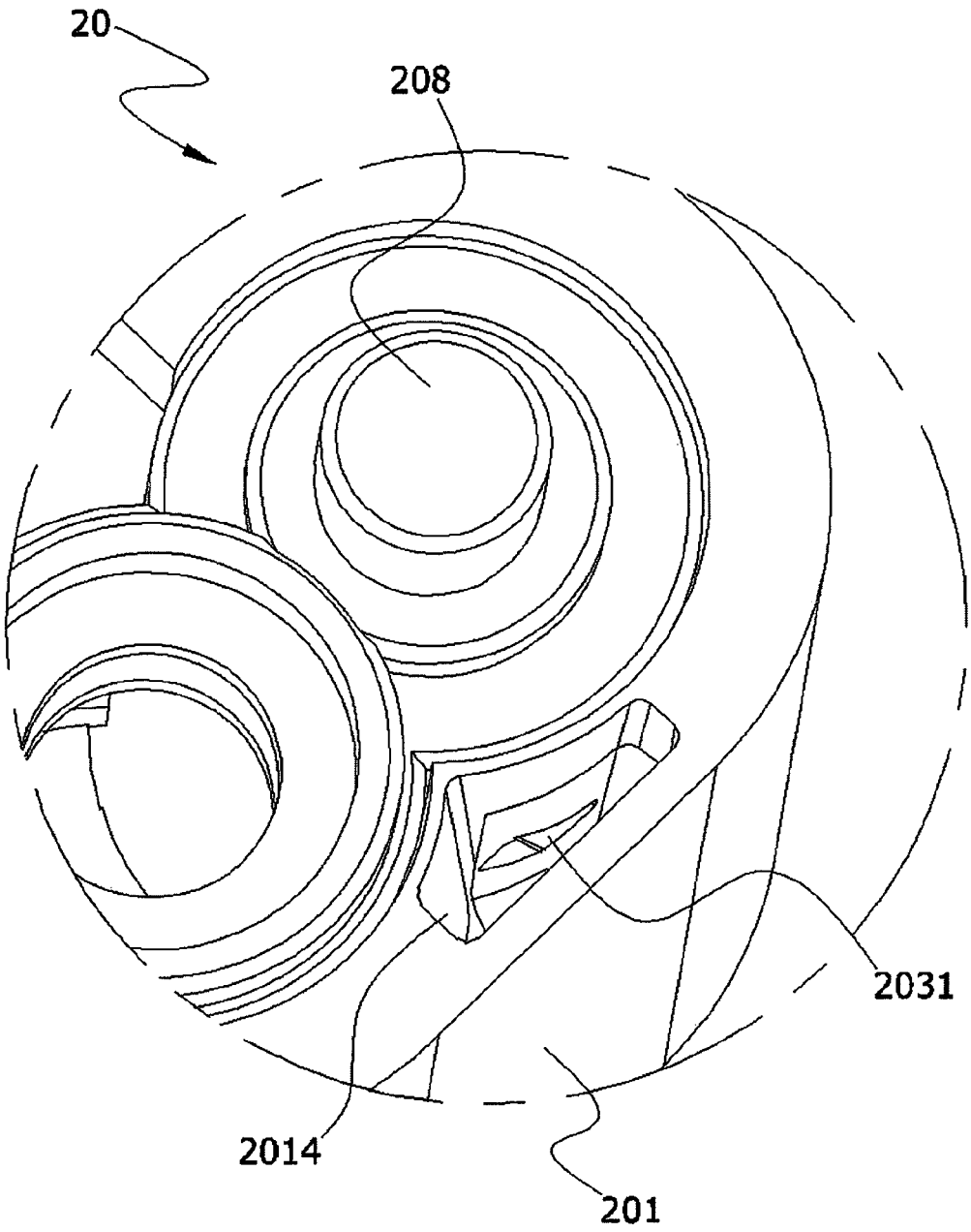
FIG. 9 is a schematic assembly view (7) of components of the present invention.

FIG. 7 is a schematic assembly view (5) of components of the present invention. Referring to FIG. 7, after the above components are completely assembled, a drive element 208 is assembled on an upper edge of the second rotor 205, an engagement portion 2081 is formed on a lower edge of the drive element 208, and the shape and the size of the engagement portion 2081 correspond to the second rotor 205. In addition, during the assembling of the drive element 208, the drive element 208 is fixed on the relative rotation shaft 207 due to the stop of the protruding rib 2072 of the relative rotation shaft 207, and the engagement portion 2081 may properly and axially displace on the second rotor 205 vertically. In a common state, the engagement portion 2081 is partially engaged with the second rotor 205. FIG. 8 is a schematic assembly view (6) of components of the present invention. Referring to FIG. 8, the transmission element 203 is assembled on the first rotor 204 and the drive element 208, in which a first air vent 2031 (not shown) is formed in the transmission element 203, and passes through a bottom edge and a side edge of the transmission element 203, so as to exhaust compression air generated during the operation of the air compression device 20. In addition, the appearance of the transmission element 203 is formed according to a shape of an inner edge of the housing 201, and is enable to displace vertically through the inner edge of the housing 201, and a protruding portion 2032 is formed on an outer edge of the transmission element 203. During the assembling, the protruding portion 2032 is assembled in the groove 2012 on the housing 201, and is fixed on the rotation shaft casing 2064. When the transmission element 203 and the housing 201 are completely assembled, an air inlet 2013 is formed between the protruding portion 2032 and the groove 2012, and the size of the air inlets 2013 varies according to different positions of the protruding portion 2032 assembled in the groove 2012. In addition, an assembling groove 2033 is formed on the transmission element 203, and an assembling hole 2034 is formed on an area close to a center of the assembling groove 2033, so that the drive element 208 passes through the assembling hole 2034, and is assembled together with a rotation element 2035. In this way, the drive element 208 may rotate relative to the transmission element 203, and the rotation element 2035 may be a transmission mechanism such as a bearing. In addition, a cover 2036 may be further assembled above the transmission element 2035, and after the above components are completely assembled, the transmission element 203 and a bottom edge of the first rotor 204 are closely fitted, and the components are also closely attached to each other. In this way, an air chamber 2011 (as shown in FIG. 2) is formed in the housing, and is closed. FIG. 9 is a schematic assembly view (7) of components of the present invention. Referring to FIG. 9, the first air vent 2031 on the transmission element 203 is in communication with the exhaust channel 2014 on the housing 201, and in this way, the compression air generated through the operation of the two rotors (204, 205) may be exhausted to the exhaust channel 2014 through the first air vent 2031 of the transmission element 203.

Figure 10:
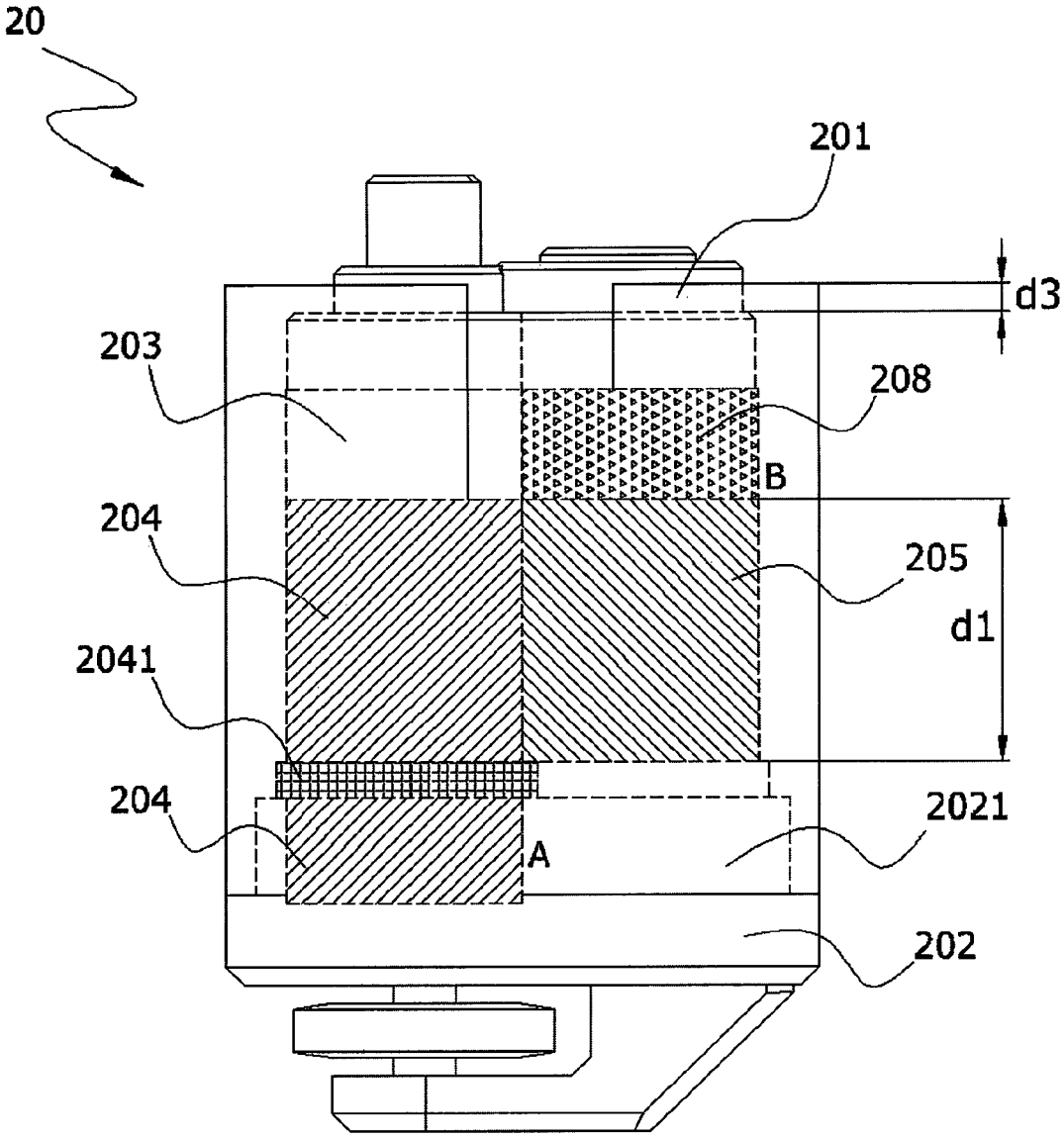
FIG. 10 is a schematic implementation view (1) of the present invention.
Figure 11:
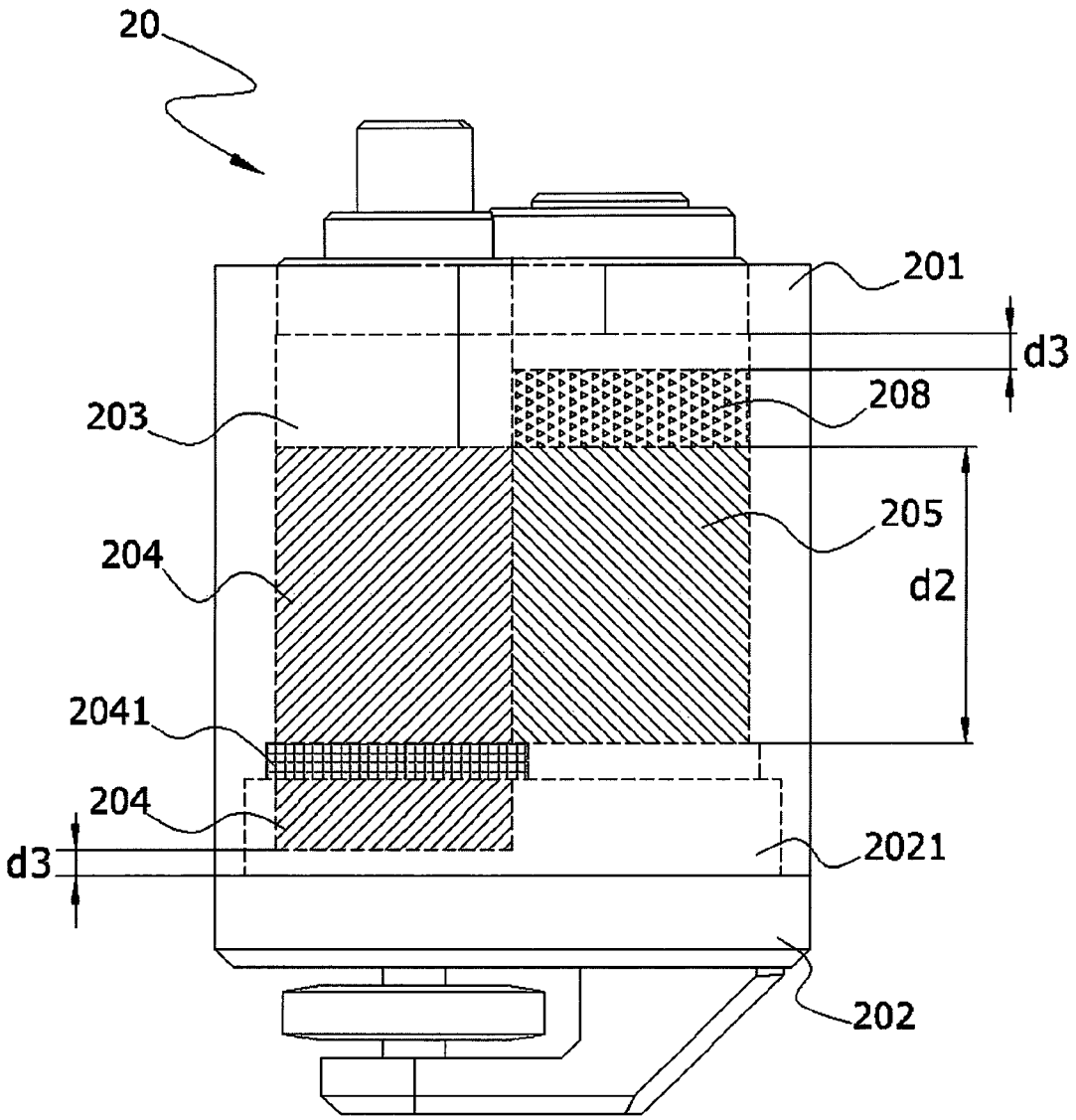
FIG. 11 is a schematic implementation view (2) of the present invention.

FIG. 10 is a schematic implementation view (1) of the present invention. Referring to FIG. 10 in combination with FIG. 2 and FIG. 7, when external air enters the air chamber 2011 through the air inlet 2013, the external air is compressed by the two rotors (204, 205) to generate compression air, and then the compression air is exhausted through the exhaust channel 2014 to generate power. However, the magnitude of the generated power is determined by the air output generated in the air chamber 2011. Therefore, the more the external air is compressed, the higher the air output is generated; on the contrary, the generated air output is small. As shown in the figures, in the air compression device 20, in a common state, an end A of the first rotor 204 is placed in the accommodation space 2021 of the supporting base 202, and an end B of the second rotor 205 is wrapped by the engagement portion 2081 of the drive element 208. The first rotor 204 and the second rotor 205 are actuated by two actuation portions (2061, 2071) to axially rotate left and right in the common state, so that the air is compressed and then exhausted through the exhaust channel 2014 to generate the required power. FIG. 11 is a schematic implementation view (2) of the present invention. Referring to FIG. 11, when a user wants to generate a different power output demand, the transmission element 203 is driven to generate an axial displacement vertically, so as to adjust the capacity of the air chamber 2011. As shown in the figure, in order to generate high power output, the transmission element 203 is actuated to displace upwards, and then the first rotor 204 and the drive element 208 are driven to displace. In this way, the part of the end A of the first rotor 204 in the accommodation space 2021 is decreased, and the area of the end B of the second rotor 205 wrapped by the 2081 is also decreased. In this way, the capacity of the air chamber 2011 is increased, and the generated air output is improved. Referring to FIG. 10 and FIG. 11, as for the capacity d1 and d2 as shown in the figures, when the transmission element 203 displaces upwards by a distance d3, the first rotor 204 and the drive element 208 are driven to displace upwards by a distance d3. In this way, the part of the first rotor 204 in the accommodation space 2021 is decreased by a distance d3, and the engagement portion 2081 of the second rotor 205 is separated from the second rotor 205 by a distance d3. Therefore, the capacity d2 is larger than the capacity d1 by a capacity of the distance d3. In addition, since the transmission element 203 displaces upwards, the air inlet 2013 between the groove 2012 and the protruding portion 2032 is enlarged, and the air input and the air output of the air compression device 20 are both increased accordingly. Accordingly, in order to enable the air compression device 20 to meet different power output demands, the transmission element 203 is enabled to axially displace vertically. When the transmission element 203 displaces upwards, the capacity of the air chamber 2011 may be increased, and the air output is improved accordingly. On the contrary, the capacity of the air chamber 2011 may be decreased, and the air output generated by the air compression device 20 is also decreased.

Figure 12:
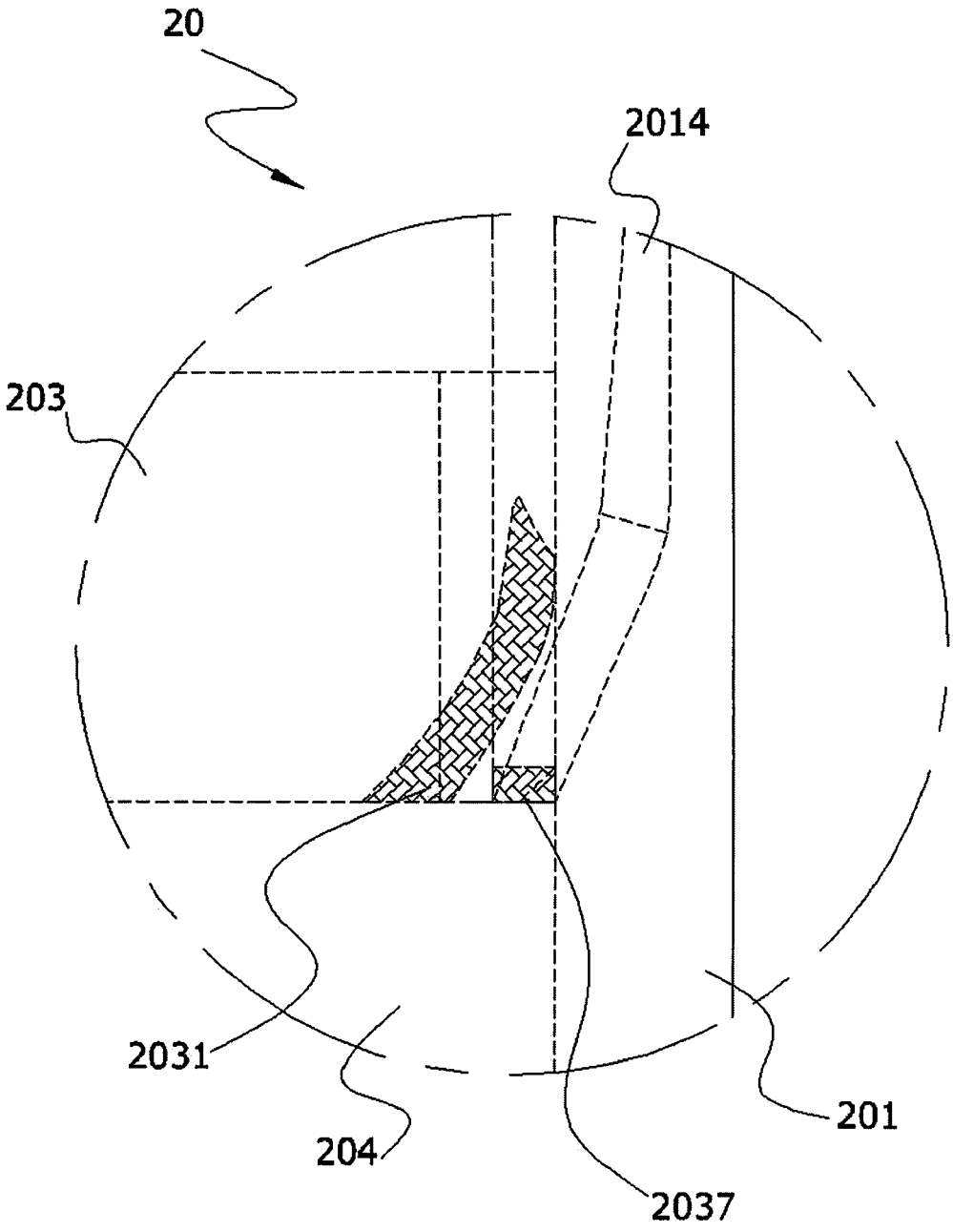
FIG. 12 illustrates another embodiment of the present invention.
Figure 13:
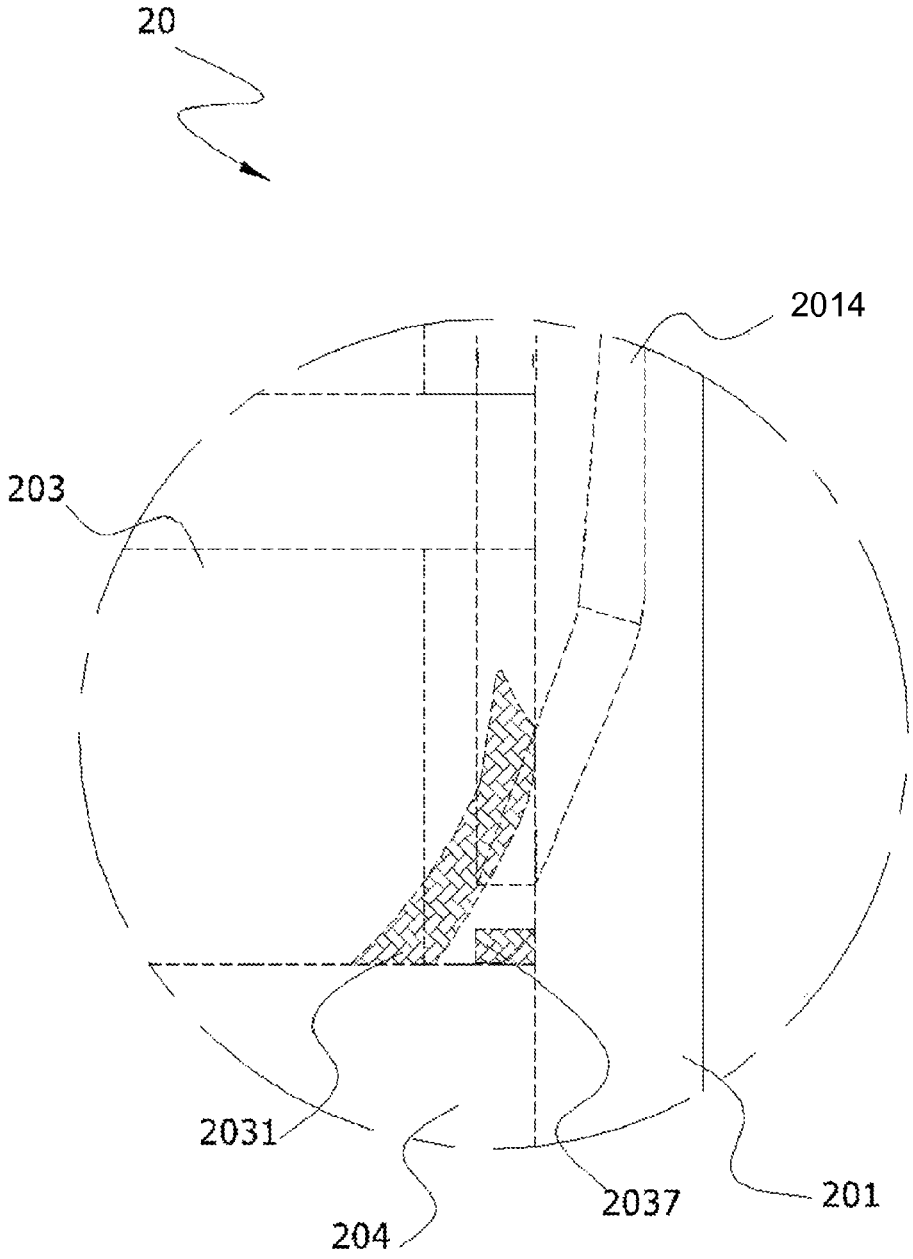
FIG. 13 is a schematic implementation view of another embodiment of the present invention.

FIG. 12 illustrates another embodiment of the present invention. Referring to FIG. 12, when a capacity of an air chamber 2011 of an air compression device 20 is increased, the generated air output is also increased. In order to avoid that a first air vent 2031 fails to effectively exhaust compression air in the air chamber 2011, in this embodiment, a second air vent 2037 is further formed in a bottom edge of a transmission element 203, so that the compression air may be fast exhausted from the air chamber 2011 through the first air vent 2031 and the second air vent 2037. As show in the figure, when the transmission element 203 displaces upwards, the second air vent 2037 is gradually in communication with the exhaust channel 2014, and in this way, the compression air may be exhausted through the first air vent 2031 and the second air vent 2037 at the same time. FIG. 13 is a schematic implementation view of another embodiment of the present invention. Referring to FIG. 13, when the transmission element 203 displaces downwards, the capacity of the air chamber 2011 is decreased, and the second air vent 2037 is gradually isolated with the exhaust channel 2014 due to the downward displacement of the transmission element 203. In this way, the compression air is merely exhausted through the first air vent 2031 as the second air vent 2037 cannot exhaust. Therefore, more than one air vent (2031, 2037) may be opened according to the capacity of the air chamber 2011 in this embodiment, so that the compression air in the air chamber 2011 can be fast exhausted from the air chamber 2011. Moreover, in this embodiment, only the second air vent 2037 is added to share and relieve the improved air output when the capacity of the aim chamber 2011 is increased, but the present invention is not limited thereto, and a third air vent or a fourth air vent may be formed as desired.

To sum up, in the air compression device of the present invention, the first rotor and the second rotor are assembled in a misalignment manner, when the external air enters the air chamber, the air is axially compressed by the two rotors left and right, and the first rotor and the second rotor axially displaces vertically through the drive of the transmission element, so that the capacity of the air chamber can be changed as desired, so as to change the air input and air output generated in the air compression device. Therefore, after the implementation of the present invention, the air compression device provided by the present invention can change the capacity of the air chamber.

To sum up, the above descriptions are merely preferred embodiments of the present invention, but are not intended to limit the present invention. Any modification, equivalent replacement, or improvement made without departing from the spirit and principle of the present invention should fall within the scope of the present invention.

LIST OF REFERENCE NUMERALS

10 Air compression device
101 Air chamber
102 Air inlet
1011 First rotor
1012 Second rotor
20 Air compression device
201 Housing
202 Supporting base
2011 Air chamber
2021 Accommodation space
2012 Groove
2022 Bulkhead
2013 Air inlet
2023 Sleeve portion
2014 Exhaust channel
2015 Relative sleeve portion
203 Transmission element
204 First rotor
2031 First air vent
2041 Stop disk
2032 Protruding portion
2042 Through hole

2033 Assembling groove
2034 Assembling hole
2035 Rotation element
2036 Cover
2037 Second air vent
205 Second rotor
206 Rotation shaft
2051 Assembling hole
2061 Actuation portion
2052 Assembling groove
2062 Slide portion
2063 Slide block
2064 Rotation shaft casing
2065 Stop portion
207 Relative rotation shaft
208 Drive portion
2071 Relative actuation portion
2081 Engagement portion
2072 Protruding rib
A End edge
B End edge
d1 Capacity
d2 Capacity
d3 Distance

What is claimed is:

1. An air compression device, comprising:

a housing, having an air chamber formed therein, wherein the air chamber is in communication with an exhaust channel formed on a surface of the housing;

a first rotor and a second rotor, respectively assembled in the air chamber of the housing, wherein the two rotors are relatively rotating to compress the air, and an end of the first rotor is assembled with a rotation shaft casing;

a drive element, formed with an engagement portion, wherein the engagement portion is assembled on one end of the second rotor;

a transmission element, formed with a first air vent, and assembled on the housing to form an air inlet, wherein the air inlet is in communication with the air chamber, the transmission element is fixed on the rotation shaft casing of the first rotor, and is assembled with the drive element; and when the transmission element displaces axially, the drive element and the first rotor are driven to displace axially, so that the engagement portion acts correspondingly to change a capacity of the air chamber.

2. The air compression device according to claim 1, wherein the housing and a supporting base are assembled together, an accommodation space is formed in the supporting case, and an end edge of the accommodation space has a bulkhead.

3. The air compression device according to claim 2, wherein a stop disk is sleeved on the first rotor, so that one end of the first rotor is arranged in the accommodation space.

4. The air compression device according to claim 3, wherein the stop disk presses against the bulkhead after being assembled.

5. The air compression device according to claim 3, wherein a through hole is formed in the stop disk, and the through hole corresponds to a size of the first rotor.

6. The air compression device according to claim 5, wherein a slide portion is formed on a rotation shaft, and is assembled with a slide block, a stop portion is formed on the rotation shaft casing, and the slide block and the stop portion are assembled together during assembling.

7. The air compression device according to claim 5, wherein the rotation shaft has an actuation portion.

8. The air compression device according to claim 1, wherein a groove is formed in the housing.

9. The air compression device according to claim 1, wherein the second rotor is assembled on a relative rotation shaft.

10. The air compression device according to claim 9, wherein the relative rotation shaft has a relative actuation portion.

11. The air compression device according to claim 9, wherein a protruding rib is formed on the relative rotation shaft.

12. The air compression device according to claim 1, wherein the rotation shaft casing is sleeved on a rotation shaft, and the rotation shaft is assembled in the housing.

13. The air compression device according to claim 1, wherein the second rotor is assembled on a relative rotation shaft, and the relative rotation shaft is assembled in the housing.

14. The air compression device according to claim 1, wherein a second air vent is formed in the transmission element.

15. The air compression device according to claim 1, wherein a assembling hole is formed in the transmission element.

16. The air compression device according to claim 1, wherein a assembling groove is formed in the transmission element.

17. The air compression device according to claim 16, wherein a rotation element is assembled on the assembling groove.

18. The air compression device according to claim 1, wherein the transmission element is assembled with a cover.

* * * * *